US007055205B2

(12) United States Patent
Aoyama

(10) Patent No.: US 7,055,205 B2
(45) Date of Patent: Jun. 6, 2006

(54) TOOTHBRUSH AND HEAD THEREOF

(76) Inventor: Yoshihiro Aoyama, 1-3-8, Hiroo, Shibuya-ku, Tokyo (JP)

( * ) Notice: Subject to any disclaimer, the term of this patent is extended or adjusted under 35 U.S.C. 154(b) by 98 days.

(21) Appl. No.: 10/324,044

(22) Filed: Dec. 20, 2002

(65) Prior Publication Data

US 2003/0115705 A1 Jun. 26, 2003

(30) Foreign Application Priority Data

Dec. 21, 2001 (JP) ..... 2001-390248

(51) Int. Cl.
*A46B 7/04* (2006.01)
*A46B 5/00* (2006.01)
*A46B 9/04* (2006.01)

(52) U.S. Cl. ..... 15/172; 15/201; 15/167.1

(58) Field of Classification Search ..... 15/167.1, 15/201, 202, 172, 22.1, 184, 185, 244.1; 401/286

See application file for complete search history.

(56) References Cited

U.S. PATENT DOCUMENTS 3,398,421 A * 8/1968 Rashbaum ..... 15/167.1
3,590,414 A * 7/1971 Gores ..... 15/4
4,476,604 A * 10/1984 White et al. ..... 15/105
4,530,369 A * 7/1985 Adams ..... 132/311
4,654,922 A * 4/1987 Chen ..... 15/172
5,120,225 A * 6/1992 Amit ..... 433/216
5,504,959 A * 4/1996 Yukawa et al. ..... 15/22.1
5,784,742 A * 7/1998 Giuliani et al. ..... 15/22.1
5,799,356 A * 9/1998 Kawashima ..... 15/167.1
6,140,723 A * 10/2000 Matsui et al. ..... 310/81
6,374,450 B1 * 4/2002 Aoyama ..... 15/167.1
6,402,410 B1 * 6/2002 Hall et al. ..... 401/146
6,568,020 B1 * 5/2003 Hosokawa ..... 15/22.1
6,612,770 B1 * 9/2003 Aoyama ..... 401/286
6,704,965 B1 * 3/2004 Ale et al. ..... 15/167.1
2001/0054211 A1 * 12/2001 Cabedo-Deslierres et al. ..... 15/106
2003/0066145 A1 * 4/2003 Prineppi ..... 15/22.1

* cited by examiner

*Primary Examiner*—Mark Spisich
*Assistant Examiner*—Shay L. Balsis
(74) *Attorney, Agent, or Firm*—Rader, Fishman & Grauer PLLC

(57) ABSTRACT

The toothbrush can prevent harmful effects that the conventional toothbrushes frequently give and is composed of disintegratable or replaceable parts, so that a user can select an optimum toothbrush by combining suitable parts depending on the individual user's specificity. The toothbrush contains a head having bristles implanted therein, a neck having the head attached to the distal end thereof and a holder for holding the neck. The head is a single piece or is composed of a plurality of head segments. The holder is provided at the distal end thereof with an adjuster for adjusting the length of the neck protruding from the holder.

17 Claims, 13 Drawing Sheets

TOOTHBRUSH AND HEAD THEREOF

BACKGROUND OF THE INVENTION

1. Field of the Invention

The present invention relates to a toothbrush essentially consisting of a head having tooth-brushing bristles implanted therein, a neck having the head attached to the distal end thereof and a holder for holding the neck, wherein the neck is telescopically engaged with the holder to enable adjustment of the length of the neck to protrude from the holder. The present invention also relates to an adjustable head used in the toothbrush.

2. Description of the Related Art

Conventional toothbrushes are simply directed to cleaning furry teeth, and they come in different types in terms of the shape of the handle, the size of the head, the stiffness of bristles implanted in the head, etc. For example, some toothbrushes have curved handles, some others have small heads, and some others have bristles whose stiffness is varied from spot to spot on the head, so that users can select optimum ones in accordance with use conditions including the user's mouth size and the like.

Tooth brushing is not merely directed to cleaning teeth, but optimum oral condition can be maintained if a user selects an optimum toothbrush taking individual specificity into consideration, including the size of teeth, dentition, occlusion, intraoral volume, sex, age and dextrality or sinistrality. Accordingly, the necessity of such consideration is advocated when a user selects a toothbrush. More specifically, it should be appreciated that a toothbrush is a buccal cleaning device or oral conditioner for optimizing the oral condition and preventing harmful effects that the conventional toothbrushes frequently give.

In terms of optimization of oral condition, it is difficult for some of the conventional toothbrushes described above to meet the above requirements. Further, there is a limit for a single toothbrush to clean ones teeth entirely, and some teeth cannot be brushed sufficiently depending on the position and portion of each tooth.

In some cases, bristles implanted in the head injure the teeth or gums.

SUMMARY OF THE INVENTION

Accordingly, the object of the present invention is to provide a toothbrush which can prevent harmful effects that the conventional toothbrushes frequently give and is provided with a dividable and/or replaceable head and other replaceable elements, wherein any of these elements are designed to be adjustable and selectable depending on the individual user to enable optimum brushing of teeth considering individual specificity including dentition.

Another object of the present invention is to provide a totally adjustable toothbrush or oral conditioner which can be incorporated with an auxiliary cleaning utensil and/or a chemical solution, so that dentists, dental hygienists, dental mechanics, etc. can prescribe toothbrushes so as to implement preventive programs and to enable adjustment of oral conditions.

To describe specifically, the toothbrush according to the present invention is characterized in that it contains a head having bristles implanted therein, a neck having the head attached to the distal end thereof and a holder for holding the neck; wherein some or all of these elements are designed to be adjustable.

Further, the toothbrush is characterized in that the head is a single piece of head or contains a plurality of head segments, and the holder has at the distal end an adjuster for adjusting the length of the neck.

Further, the toothbrush is characterized in that the holder contains a holder shaft and an outer holder.

Further, the toothbrush is characterized in that the head is a single piece of head or contains a plurality of head segments, and the head or each head segment is designed to be slidable, pivotal and replaceable with respect to the neck.

Further, the toothbrush is characterized in that the neck contains a neck shaft which is of any shape and is selected from a round shaft, an elliptic shaft and a polygonal shaft, and which is straight or curved and has a single shaft or multi-shaft structure.

Further, the toothbrush is characterized in that the neck shaft is hollowed, and the cavity of the neck shaft is employable as a passage for a liquid, a gas, a solid, a powder or a granule, or as a space in which a mechanism such as a sound wave generator is housed.

Further, the toothbrush is characterized in that the neck shaft contains two kinds of auxiliary cleaning utensils which can as necessary be used simultaneously.

Further, the toothbrush is characterized in that the head or each head segment has a protrusion on the bottom surface.

Further, the toothbrush is characterized in that some or all of the head, the neck and the holder are designed to be adjustable in length with adjusters respectively.

Further, the toothbrush is characterized in that the head or the head segments contain magnet pieces, while the neck contains a vibrator to effect high-speed vibration of bristle tips and that some or all of the head, the neck and the holder are designed to be adjustable in length with adjusters respectively.

Further, the toothbrush is characterized in that all of the elements are made of a sterilized material.

The toothbrush is also characterized in that it contains a head having bristles implanted therein, a neck having the head attached to the distal end thereof and a holder having a structure in which the neck shaft is designed to slide into and out of the holder shaft.

Meanwhile, the head of a toothbrush according to the present invention is a single piece of head or contains a plurality of head segments, which is or are designed to be slidable, pivotal and replaceable with respect to a neck of the toothbrush.

Further, the head is characterized in that it has a sponge-like cleaning element formed on a surface thereof.

Other aspects and advantages of the invention will become apparent from the following description, taken in conjunction with the accompanying drawings illustrated by way of examples the principles of the invention.

BRIEF DESCRIPTION OF THE DRAWINGS

The features of the present invention that are believed to be novel are set forth with particularity in the appended claims. The invention together with the objects and advantages thereof, may best be understood by reference to the following description of the presently preferred embodiments together with the accompanying drawings in which:

DETAILED DESCRIPTION OF THE PREFERRED EMBODIMENTS

Modes for carrying out the present invention will be described below referring to the attached drawings.

Figure 1:
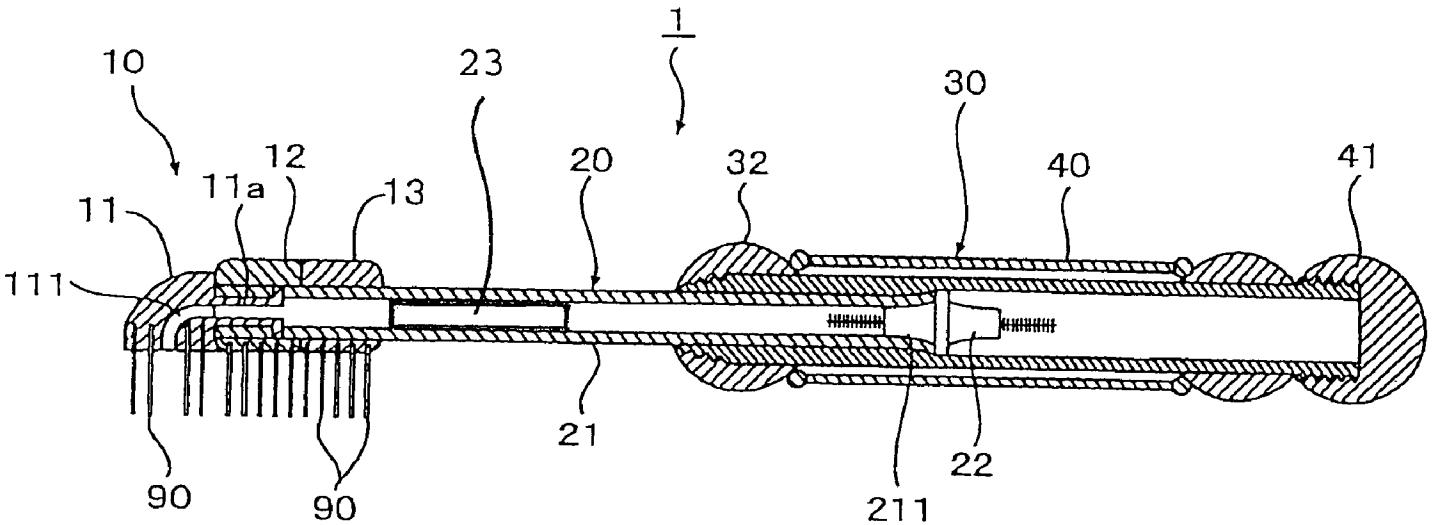
FIG. 1 is a partly cross-sectional side view of the toothbrush according to a first embodiment of the present invention.

FIG. 1 is a partly cross-sectional side view of the toothbrush 1 according to a first embodiment of the present invention.

As shown in FIG. 1, the toothbrush 1 consists essentially of a head 10 containing a plurality of head segments, a neck 20, and a holder 30. In this embodiment, while the head 10 is composed of a combination of a first head segment 11, a second head segment 12 and a third head segment 13, the number of head segments is not limited to three, but a combination of a suitable number of head segments can be used depending on the tooth form, dentition, etc. of a user.

While the forefront first head segment 11 is removably secured to the distal end of the neck shaft 21 through a resilient fitting portion 11*a* in this embodiment, there are other employable constitutions of fitting the first head segment 11 which will be described later. The reference number 111 denotes a channel defined through the first head segment 11.

Both the second head segment 12 and the third head segment 13 are designed to be pivotal, slidable and replaceable independent of each other with respect to the neck 20. Thus, bristles 90 implanted in the head 10 can be applied to the tooth surfaces exactly and with appropriate forces, respectively.

Next, the neck 20 will be explained.

As shown in FIG. 1, the neck 20 has a hollow cylindrical shaft 21 and also has the head 10 and an auxiliary cleaning utensil such as an interdental brush 22 secured to the distal end portion and to the proximal end portion, respectively.

The neck shaft 21 is inserted to a holder shaft 31 (to be described later) having an adjuster 32 provided at the distal end thereof, so that the length of the neck shaft 21 can be adjusted with the adjuster 32. Thus, the toothbrush 1 enjoys advantages that the length of the toothbrush 1 can be changed depending on the size of a user's buccal cavity and that the neck can be telescopically housed in the holder shaft 31 conveniently.

The head or the head segments contains magnet pieces, while the neck may contain a mechanism such as a vibrator to effect high-speed vibration of bristle tips and some or all of the head, the neck and the holder are designed to be adjustable in length with adjusters respectively.

Further, since an interdental brush 22 is attached to the rear end of the neck shaft 21, the neck shaft 21 serves as a handle for the brush 22, leading to saving of materials. In addition, since the interdental brush 22 is held by the long neck shaft 21, a user can use the auxiliary cleaning utensil such as the interdental brush 22 in a sanitary condition without fouling the fingers.

In the case where the interdental brush 22 is secured through slits 211 defined at the rear end portion of the neck shaft 21 like in this embodiment, the slits 211 are widened to expand the rear end portion to allow that portion to serve as a stopper for preventing the neck shaft 21 from slipping off from the holder shaft 31.

This neck shaft 21 may not necessarily be of the hollow cylindrical shape as used in this embodiment, but a solid cylindrical shaft or a hollow or solid square shaft can also be used. Further, the neck shaft 21 may be tapered such that the thickness thereof reduces gradually.

Figure 24:
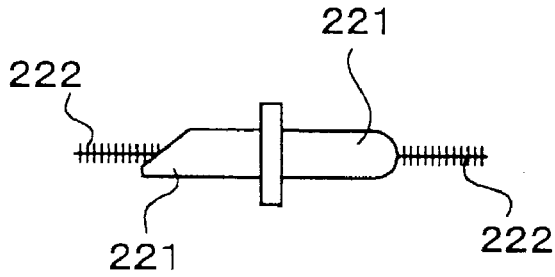
FIG. 24 is a front view showing another exemplary interdental brush.
Figure 25:
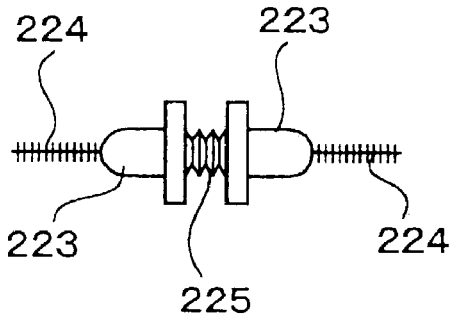
FIG. 25 is a front view showing another exemplary interdental brush.

While the interdental brush 22 may have a brush at one end of a retainer, it may have a brush at each end of the retainer as shown in FIGS. 24 and 25. More specifically, in the interdental brush 22 shown in FIG. 24, the retainer 221 is a single piece and has a brush 222 at each end thereof.

Meanwhile, the interdental brush 22 shown in FIG. 25 has a pair of retainers 223 as separate pieces each having a brush 224, and the retainers 223 are connected to each other with a connecting piece 225.

Next, the adjuster 32 will be explained.

The adjuster 32 in this embodiment is turned to secure the rear end portion of the neck shaft 21 inserted through it into the holder shaft 31.

As shown in FIG. 1, the holder 30 contains the cylindrical holder shaft 31 which admits insertion of the neck shaft 21 and turning thereof, and the adjuster 32 can adjust the insertion length and running torque of the neck shaft 21. More specifically, since the length of the toothbrush 1 can be changed by adjusting the insertion length of the neck shaft 21, the toothbrush can transmit the brushing pressure exactly to fingers to enable brushing of teeth with an appropriate pressure.

Further, since the holder 30 admits turning of the neck shaft 21, those users who have troubles with their fingers can change the angle of the head 10 without changing the positions of fingers when they brush each tooth surface, conveniently. Thus, the bristles on the head 10 can be applied to each tooth with an optimum angle.

In addition, the holder shaft 31 has a cylindrical shape, it facilitates cleaning of the inside thereof and can always be maintained hygienically. Further, the cylindrical holder shaft 31 may not necessarily be straight nor have a round cross-section, but may be curved or may have an elliptical, polygonal or indeterminate cross-section.

Next, actions of this embodiment will be described.

When the toothbrush 1 according to this embodiment is used, a user adjusts the length of the neck shaft 21 with the adjuster 32, and the user grips the holder 30 and can brush his or her teeth 100.

Figure 26:
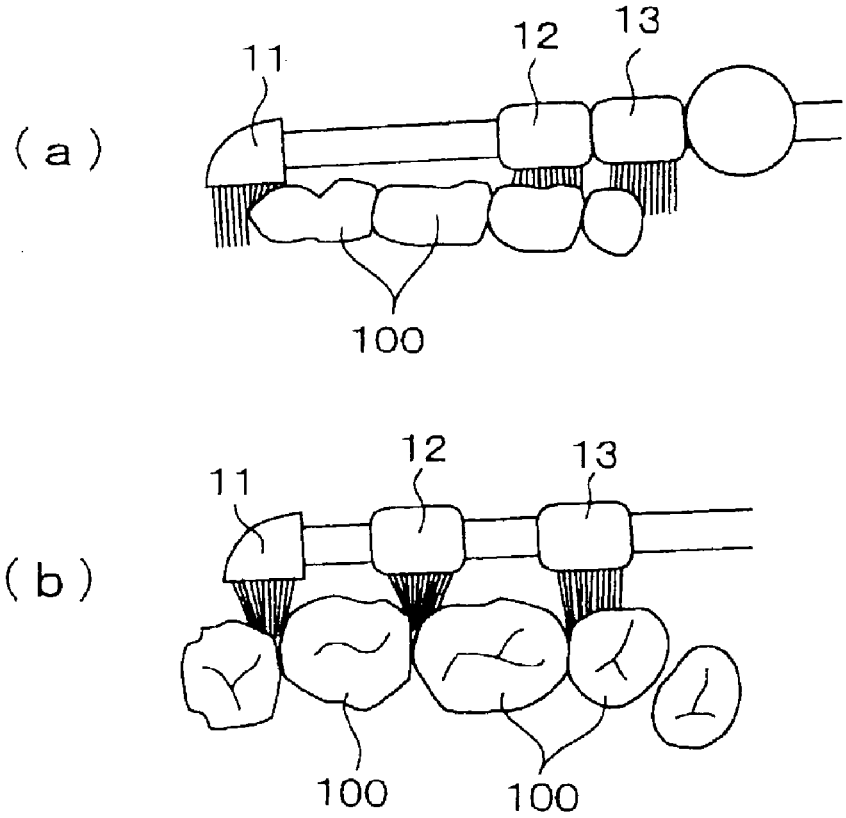
FIGS. 26(*a*) and 26(*b*) are explanatory drawings showing the state how the toothbrush is used.

Here, if the second head segment 12 and the third head segment 13 are shifted as shown in FIG. 26(*a*), the user can functionally transmit his or her will most directly to the first head segment 11.

Further, since the second head segment 12 and the third head segment 13 can be shifted to appropriate positions respectively, the distance between every adjacent two head segments can be set freely as shown in FIG. 26(*b*). Thus, a single brush can provide various forms of head 10 optimized for brushing each user's teeth.

Thus, the simple-structure toothbrush can accurately cope with adjustment for individual use to prevent dental and buccal diseases effectively by repeating a simple brushing motion.

When a chemical solution or the like is charged into the cavity of the neck shaft 21, the chemical solution seeps out to the brush surface through the channel 111 of the first head segment 11.

Effects of the first embodiment are that the head 10 is divided into the first head segment 11, the second head segment 12 and the third head segment 13, and each head segment can be shifted and adjusted independently, and that the head segments can be pivoted respectively, so that the bristle tips of the brush segments can be applied evenly and accurately to every protrusion and recess of teeth which differ depending on the individual user's dentition.

By virtue of the quantitative adjustments of the head 10, for example, by sliding or pivoting the head segments, or by deformation, deflection, etc. of other elements, the single toothbrush can suitably cope with a variety of tooth surface profiles and dentitions.

In addition, since the head segments 11, 12 and 13 can be replaced easily, the thickness, number and stiffness of bristles 90 of the toothbrush 1 can be changed depending on the individual user's specificity. Besides, dentists and the like can provide users with optimum toothbrushes 1 depending on the respective purposes. Further, the toothbrush 1 of the present invention has economic effects and energy saving effects.

Meanwhile, since the neck shaft 21 and the holder shaft 31 are hollowed, the center of gravity can suitably be positioned at the site of action by incorporating a weight or the like therein or by changing the length of the neck shaft 21, and one can continue brushing for a long time because of its lightness of the toothbrush.

Since a chemical solution and two kinds of auxiliary cleaning utensils can be incorporated into the toothbrush 1, the toothbrush can cope with all sorts of oral conditions.

Due to the relationship between the neck shaft 21 and the adjuster 32, the head 10 turns if an excessive brushing force is applied through it to the teeth to prevent hypersensitivity and sphenic chipping from occurring in teeth. When teeth are brushed strongly with the conventional toothbrushes so as to remove filth on the tooth surface, the brushes can injure the tooth surface, leading to troubles such as hypersensitivity, sphenic chipping and the like.

Thus, it is essential to brush teeth with an appropriate force along the tooth surface. However, according to the toothbrush 1 of this embodiment, the head segments 11, 12 and 13 pivot to avoid application of excessive force to the teeth 100, and the bristles intrude into the clearances between the teeth with an appropriate force to achieve secured cleaning of the teeth. Besides, the toothbrush 1 is pleasant to the teeth and can prevent the harmful effects on the teeth as described above.

Next, structures of fitting the first head segment to the distal end of the neck will be described referring to FIGS. 2 to 4.

Figure 2:
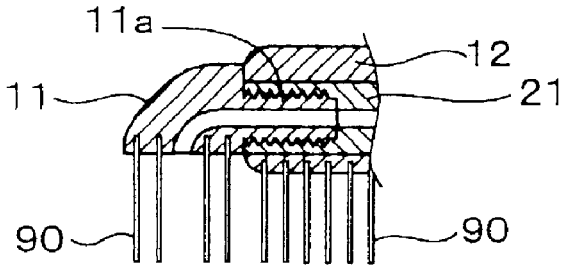
FIG. 2 is a cross-sectional partial side view of the toothbrush showing another exemplary constitution where a first head segment is attached to the distal end of the neck shaft.

In the structure shown in FIG. 2, a screw is formed as the fitting portion 11*a* at the proximal end of the first head segment 11 and is screwed into the distal end portion of the neck shaft 21.

Figure 3:
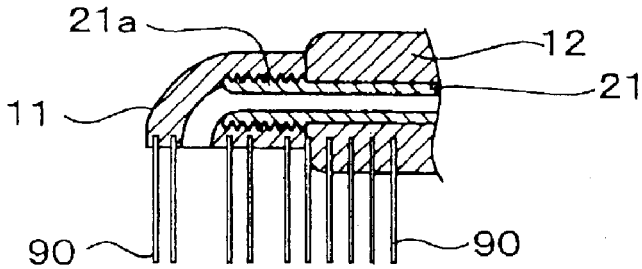
FIG. 3 is a cross-sectional partial side view of the toothbrush, showing another exemplary constitution where a first head segment is attached to the distal end of the neck shaft.

In the structure shown in FIG. 3, a screw serving as a fitting portion 21*a* is formed at the distal end of the neck shaft 21 and is screwed into the first head segment 11.

Figure 4:
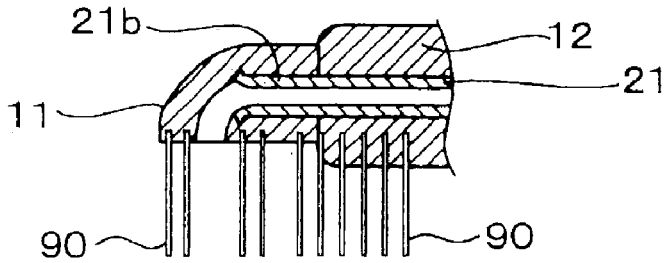
FIG. 4 is a cross-sectional partial side view of the toothbrush, showing another exemplary constitution where the first head segment is attached to the distal end of the neck shaft.

In the structure shown in FIG. 4, a spring piece serving as a fitting portion 21*b* is formed at the distal end of the neck shaft 21 and is engaged with the first head segment 11.

Next, means for securing the second head segment 12 and the third head segment 13, which is slidable with respect to the neck shaft 21, will be described referring to FIGS. 5 to 13. While the second head segment 12 is illustrated in each of the drawings, the same applies to the third head segment 13.

Figure 5:
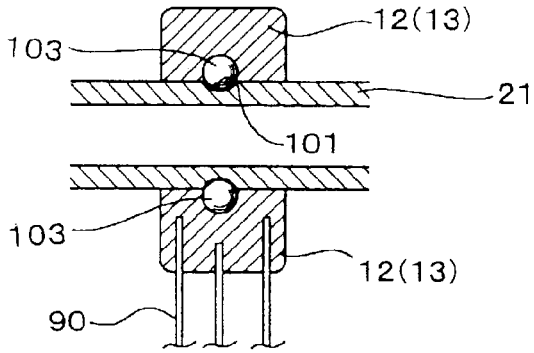
FIG. 5 is an enlarged cross-sectional partial side view of means for securing a second head segment and a third head segment to the neck shaft.

In the securing means shown in FIG. 5, a silicone rubber ring 103 fixed to the inside of the second head segment 12 is fitted in a U-shaped groove 101 defined along the circumference of the neck shaft 21 to secure the second head segment 12 against the neck shaft 21 with the tightening force of the silicone rubber ring 103.

Figure 6:
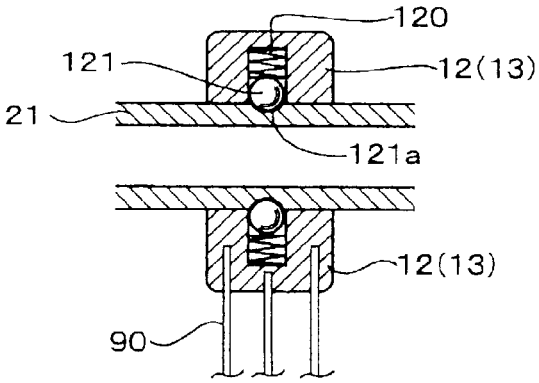
FIG. 6 is an enlarged cross-sectional partial side view of means for securing the second head segment and the third head segment to the neck shaft.

In the securing means shown in FIG. 6, a pair of springs 120 each having a pivot 121 at the distal end are fixed to the inner top and the inner bottom of the second head segment 12 respectively, and each pivot 121 is engaged with a dent 121*a* defined on the neck shaft 21 to secure the second head segment 12 against the neck shaft 21.

Figure 7:
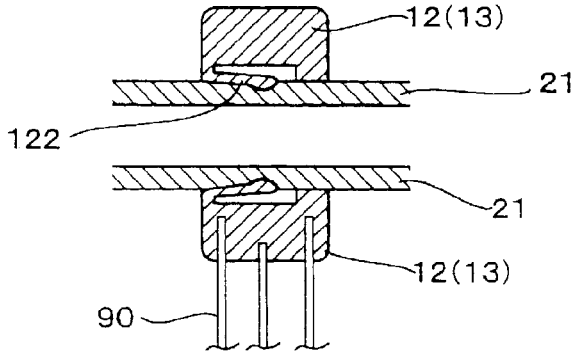
FIG. 7 is an enlarged cross-sectional partial side view of means for securing the second head segment and the third head segment to the neck shaft.

In the securing means shown in FIG. 7, a pair of slits 122 are formed on the inner upper surface and the inner lower surface of the second head segment 12, and each slit 122 is engaged with a recess defined on the neck shaft 21.

Figure 8:
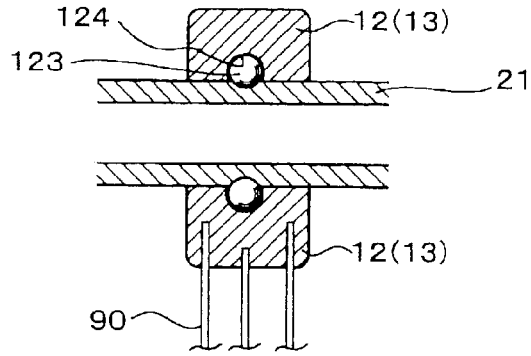
FIG. 8 is an enlarged cross-sectional partial side view of means for securing the second head segment and the third head segment to the neck shaft.
Figure 9:
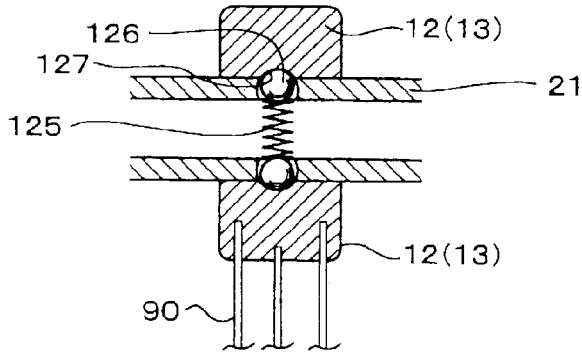
FIG. 9 is an enlarged cross-sectional partial side view of means for securing the second head segment and the third head segment to the neck shaft.
Figure 10:
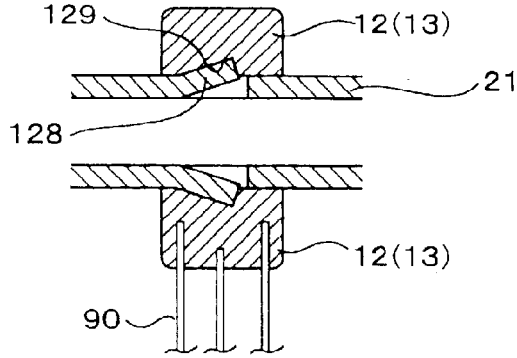
FIG. 10 is an enlarged cross-sectional partial side view of means for securing the second head segment and the third head segment to the neck shaft.

Next, contrary to the securing means shown in FIGS. 5 to 7, the securing means shown in FIGS. 8 to 10 are formed on the neck shaft 21. In the securing means shown in FIG. 8, a silicone rubber ring 123 wrapped around the neck shaft 21 is fitted in a U-shaped groove 124 defined on the internal circumference of the second head segment 12 to secure the second head segment 12 against the neck shaft 21 with the resilience of the silicone rubber ring 123.

In the securing means shown in FIG. 9, a spring 125 having a pivot 126 at each end thereof is disposed in the cavity of the neck shaft 21 such that the pivots 126 protrude slightly through openings defined at the top and the bottom of the neck shaft 21 respectively to engage each pivot with a dent 127 defined in the second head segment 12.

In the securing means shown in FIG. 10, a pair of slits 128 are defined on the upper surface and lower surface of the neck shaft 21 respectively, and each slit 128 is engaged with a recess 129 defined in the second head segment 12 to secure the second head segment 12 against the neck shaft 21.

Figure 11:
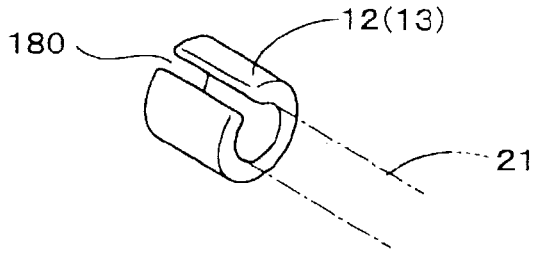
FIG. 11 is a perspective view of means for securing the second head segment and the third head segment to the neck shaft.

The securing means shown in FIG. 11 is a slit 180 formed in the second head segment 12 to secure the second head segment 12 with the tightening force of itself against the neck shaft 21.

Figure 12:
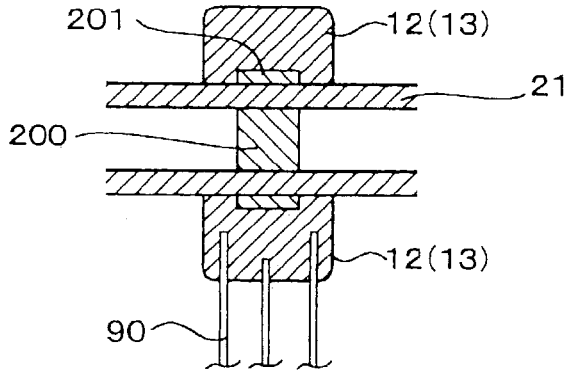
FIG. 12 is an enlarged cross-sectional partial side view of means for securing the second head segment and the third head segment to the neck shaft.
Figure 13:
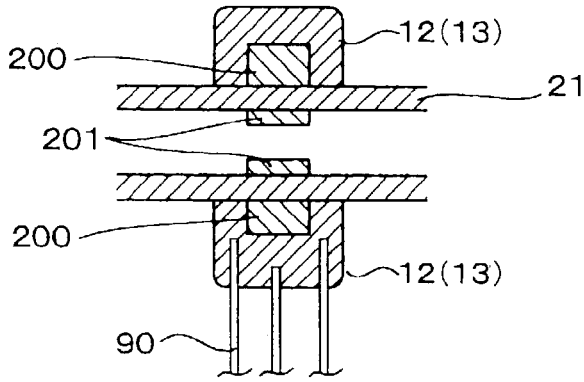
FIG. 13 is an enlarged cross-sectional partial side view of means for securing the second head segment and the third head segment to the neck shaft.

FIGS. 12 and 13 show methods for securing the second head segment 12 against the neck shaft 21 using magnet pieces. More specifically, in FIG. 12, a magnet piece 200 is provided in the shaft wall or within the neck shaft 21, and a pair of magnetic materials 201 are disposed in the second head segment 12 at the top and bottom to secure the second head segment 12 against the neck shaft 21 with the magnetic force.

Meanwhile, in FIG. 13, a pair of magnetic materials 201 are provided in the shaft wall or within the neck shaft 21, and a pair of magnet pieces 200 are disposed in the second head segment 12 at the top and bottom to secure the second head segment 12 against the neck shaft 21 with the magnetic force.

Next, adjusters of other examples will be described referring to FIGS. 14 to 17.

Figure 14:
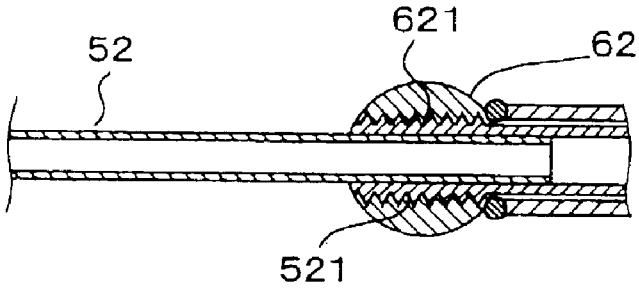
FIG. 14 is a cross-sectional partial side view of another exemplary adjusting section.

The adjuster 62 shown in FIG. 14 contains an internal thread 621 which is engaged with an external thread 521 formed on a holder shaft 631 to secure the neck shaft 52 against the holder shaft 631.

Figure 15:
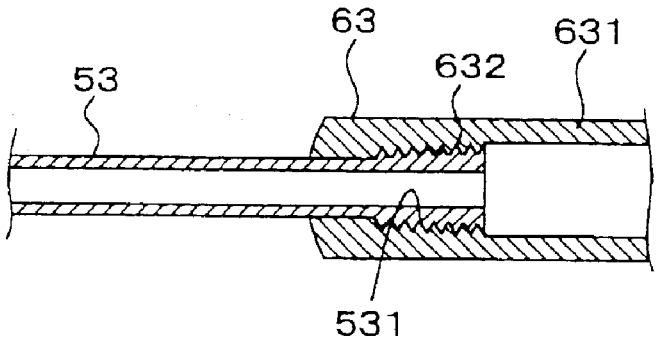
FIG. 15 is a cross-sectional partial side view of another exemplary adjusting section.

The adjuster 63 shown in FIG. 15 is provided at the distal end portion of a holder shaft 631 and contains an internal thread 632 which is engaged with an external thread 531 provided on a neck shaft 53 to secure the neck shaft 53 against the holder shaft 631. The internal thread 632 and the external thread are tapered toward the head (leftward in FIG. 15).

Figure 16:
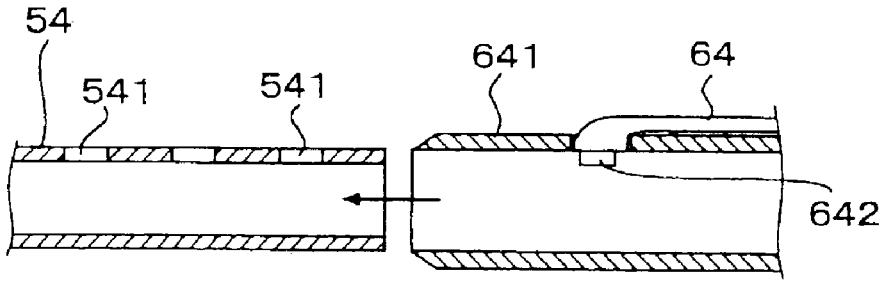
FIG. 16 is a cross-sectional partial side view of another exemplary adjusting section.

The adjuster shown in FIG. 16 contains a hook 64, with a boss 642 formed at the tip thereof, provided at the distal end portion of the holder shaft 641 which is engaged at the boss with one of openings 541 defined in the neck shaft 54 at a desired position to secure the neck shaft 54 against the holder shaft 641.

Figure 17:
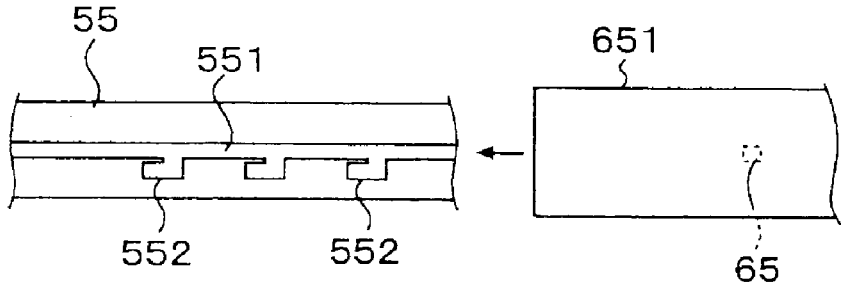
FIG. 17 is a partial plan view of another exemplary adjuster.

The adjuster shown in FIG. 17 contains a boss 65 provided inside a holder shaft 651 at the distal end portion thereof which is engaged with one of catching recesses 552 formed integrally with a slit 551 defined at the upper center of a neck shaft 55 to secure the neck shaft 55 against the holder shaft 651 at a desired position.

Next, means for securing the first head segment, the second head segment and the third head segments will be described referring to FIGS. 18 to 23.

Figure 18:
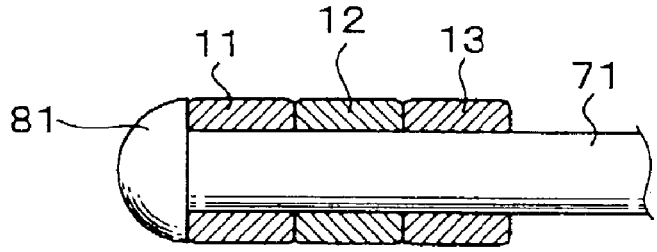
FIG. 18 is a cross-sectional partial plan view of means for securing the first head segment, the second head segment and the third head segment to the neck shaft.

The securing means shown in FIG. 18 is a stopper 81 formed integrally with a neck shaft 71 at the distal end portion thereof.

Figure 19:
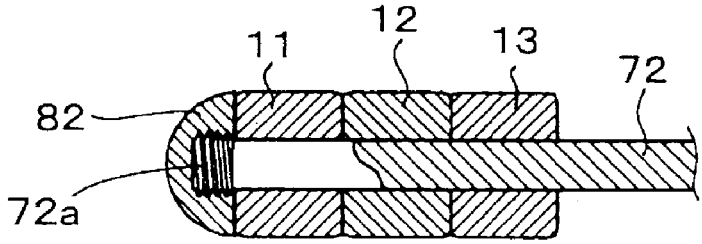
FIG. 19 is a cross-sectional partial plan view of means for securing the first head segment, the second head segment and the third head segment to the neck shaft.

The securing means shown in FIG. 19 contains a stopper 82 which is brought into screw engagement with an external thread 72*a* of a neck shaft 72.

Figure 20:
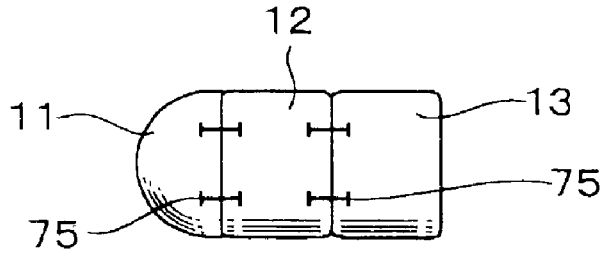
FIG. 20 is a plan view of means for securing the first head segment, the second head segment and the third head segment to one another.

The securing means shown in FIG. 20 secures the first head segment 11, the second head segment 12 and the third head segment 13 to one another with clamps 75.

Figure 21:
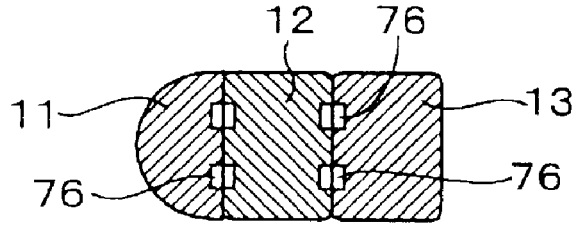
FIG. 21 is a cross-sectional plan view of means for securing the first head segment, the second head segment and the third head segment to one another.

The securing means shown in FIG. 21 secure the first head segment 11, the second head segment 12 and the third head segment 13 to one another with magnet pieces 76 interposed between them.

Figure 22:
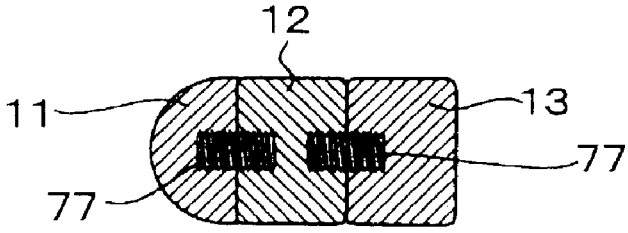
FIG. 22 is a cross-sectional plan view of means for securing the first head segment, the second head segment and the third head segment to one another.

The securing means shown in FIG. 22 secure the first head segment 11, the second head segment 12 and the third head segment 13 to one another with screws 77.

Figure 23:
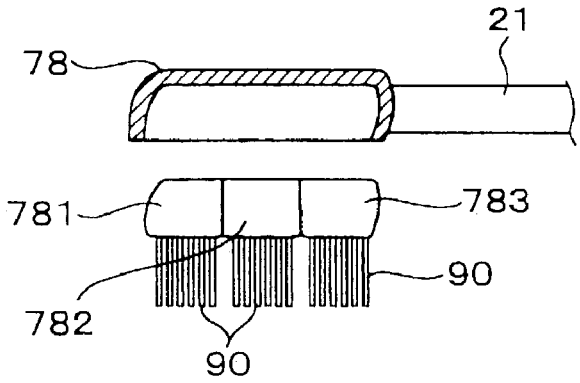
FIG. 23 is a cross-sectional partial plan view of means for securing the first head segment, the second head segment and the third head segment to the neck shaft.

FIG. 23 shows securing means 78 formed at the distal end of the neck shaft 21, and a first head segment 781, a second head segment 782 and a third head segment 783 each having a flattened top are fitted in the securing means 78.

The holder shaft 31 has a straight or curved cylindrical shape with a circular or square cross section and is provided at the distal end portion with the adjuster 32 which secures the neck shaft 21 against the holder shaft 31. The holder shaft 31 has another adjuster 41 at the proximal end thereof, which prevents the auxiliary cleaning utensil from slipping off from the holder shaft 31 and also serves as a stopper for stopping the proximal end of the neck shaft 21.

An outer holder 40 can be fitted on the holder shaft 31 to adjust the thickness or shape of the holder 30 depending on the individual user and also to adjust the brushing pressure. The outer holder 40 also serves as a protector for literal or graphic information inscribed on the holder shaft 31.

More specifically, the outer holder 40 is fitted to and secured on the normal holder shaft 31 with the rear end adjuster 41 and is suitably adjusted therewith.

Figure 27:
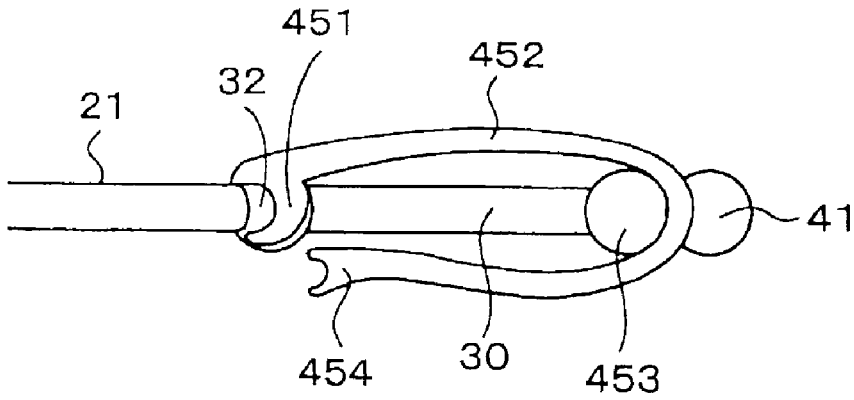
FIG. 27 is a perspective partial view of another example of outer holder.

As another example of the outer holder 40, one as shown in FIG. 27 can be used. The outer holder 40 shown in FIG. 27 contains a curved grip 452 having a forked fore supporting portion 451 for holding the adjuster 32. The curved grip 452 has at the rear end portion an annular rear supporting portion 453 and a pressing portion 454 extending forward through the rear supporting portion 453.

When the outer holder 40 is attached to the holder shaft 31, the rear adjuster 41 is removed, and the fore supporting portion 451 is slid to pass through the proximal end of the holder shaft 31 toward the fore adjuster 32 to be abutted against and secured thereto. Meanwhile, the rear supporting portion 453 is also passed through the rear end portion of the holder shaft 31 to be fitted thereon, and then the rear adjuster 41 is engaged with the proximal end portion of the holder shaft 31.

When the toothbrush is used, a user holds the grip 452 and the pressing portion 454, and thus the holder shaft 31 can be secured therewith. The reason is that the grip 452 is caused to extend, and the fore supporting portion 451 and the rear supporting portion 453 urge the adjusters 32 and 41 outward to hold them securely.

Figure 28:
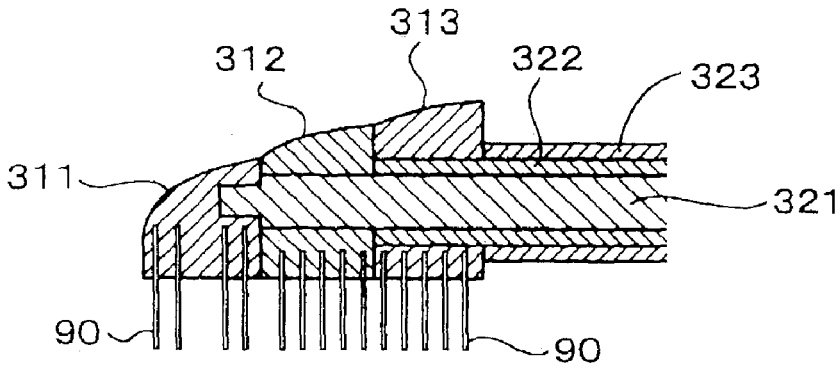
FIG. 28 is a cross-sectional partial side view showing the brush head according to a second embodiment of the present invention.

FIG. 28 shows the toothbrush according to a second embodiment of the present invention having a multi-shaft structure. The neck shaft in this embodiment has a telescopic triple shaft structure. A first head segment 311, a second head segment 312 and a third head segment 313 are secured to the distal ends of neck shafts 321, 322 and 323, respectively.

The neck shaft 322 need not necessarily surround the circumference of the neck shaft 321 completely, nor need the neck shaft 323 to surround the circumference of the neck shaft 322 completely.

Figure 29:
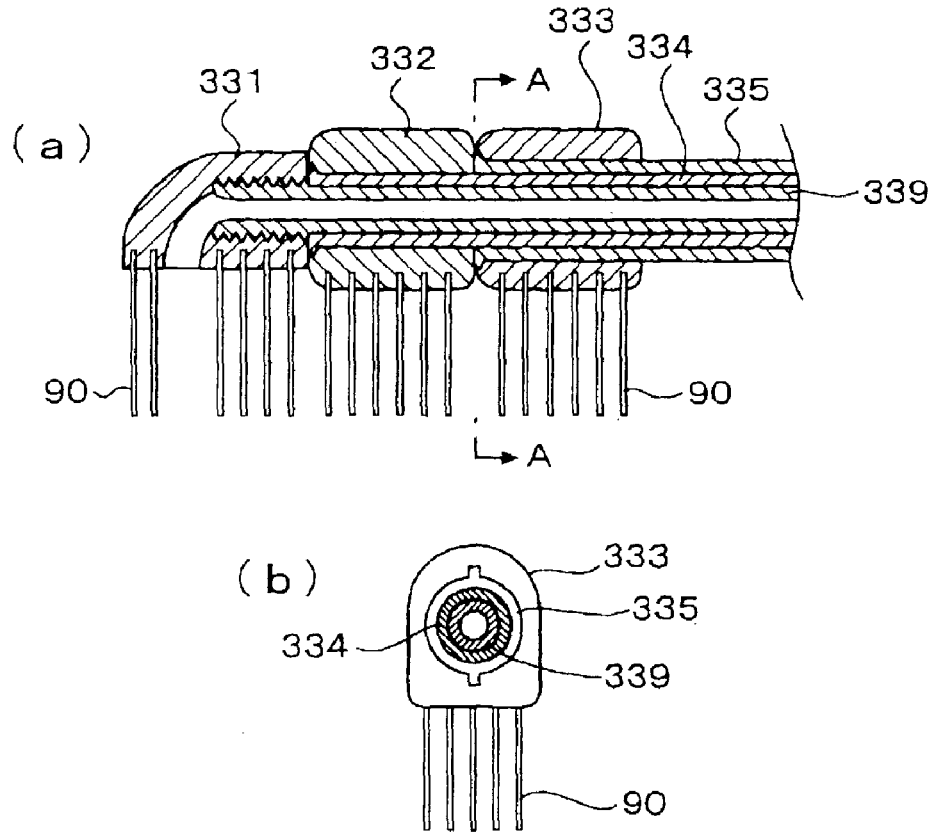
FIGS. 29(*a*) and 29(*b*) show another exemplary brush head of the second embodiment, in which 29(*a*) is a cross-sectional partial side view, and 29(*b*) is a cross-sectional view taken along the line A—A in 29(*a*)

FIG. 29 shows another example of the second embodiment containing hollow neck shafts. The toothbrush shown in FIG. 29 has a hollow neck containing an inner neck shaft 339, an intermediate neck shaft 334 and an outer neck shaft 335. A first head segment 331, a second head segment 332 and a third head segment 333 are secured to the distal ends of the inner neck shaft 339, the intermediate neck shaft 334 and the outer neck shaft 335, respectively.

Figure 30:
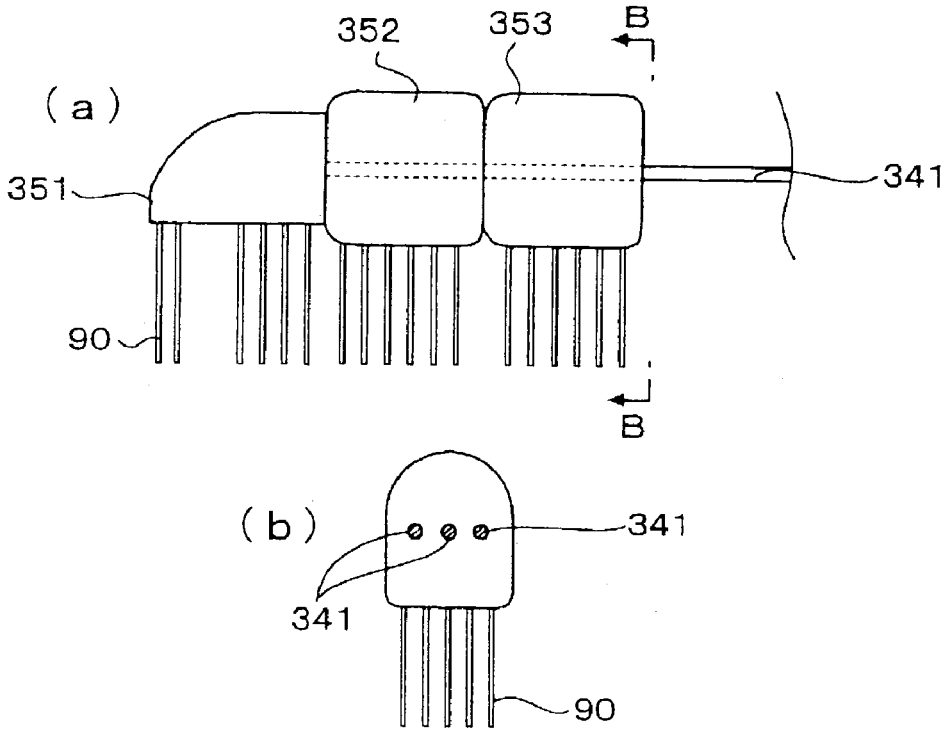
FIGS. 30(*a*) and 30(*b*) show another exemplary brush head, in which (*a*) is a partial side view, and 30(*b*) is a cross-sectional view taken along the line B—B in 30(*a*)

Another example of neck shaft 21 having a multi shaft structure is shown in FIG. 30. As shown in FIG. 30, three head segments 351, 352 and 353 can be secured to one another with three shafts 341. The first head segment 351 is secured to the distal ends of these three shafts 341. The second head segment 352 and the third head segment 353 are slidable along the shafts 341 independent of each other. The shafts 341 undergo twisting to allow pivoting of the head segments 352 and 353.

Figure 31:
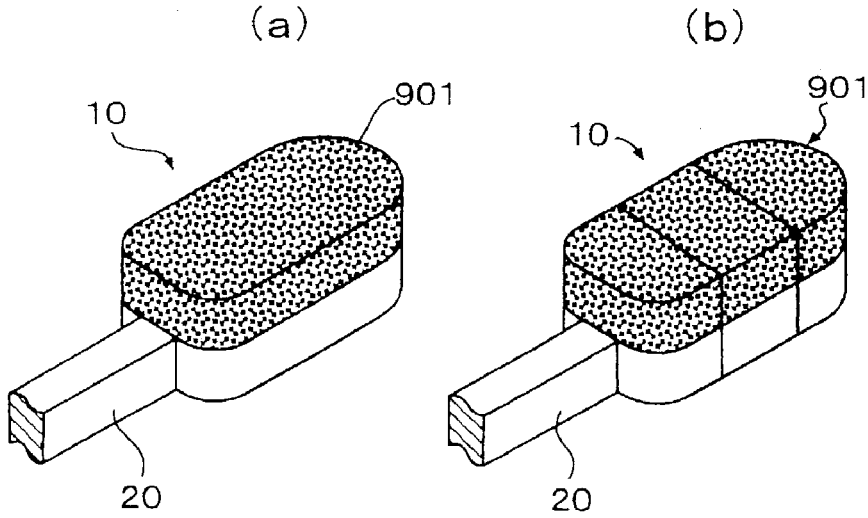
FIGS. 31(*a*) and 31(*b*) are perspective views each showing a head having a sponge piece formed thereon.

FIG. 31(*a*) shows an example of head 10 having a rectangular sponge piece 901 as a sponge-like cleaning element attached thereto in place of bristles 90.

Meanwhile, FIG. 31(*b*) shows a case where the head 10 shown in FIG. 31(*a*) consists of head segments.

According to this example, since the surface of the sponge piece 901 is brought into face contact with teeth and gums, the sponge piece 901 scarcely irritates and injures the teeth and gums compared with bristles 90, and the area of contact increases, effectively.

The sponge-like cleaning element is one directed to obtaining cleaning or massaging effects and is formed using an artificial material such as an elastic or anelastic polymeric material or a naturally occurring material by allowing such a material to assume the form of porous sponge or by cutting a silicone material and the like finely to obtain an assembly of fine fibers which as a whole looks like a lump.

Since such cleaning elements are brought into contact with each tooth with an appropriate pressure, they can reach to every nook and corner in the mouth without applying excessive stimulation thereto.

Figure 32:
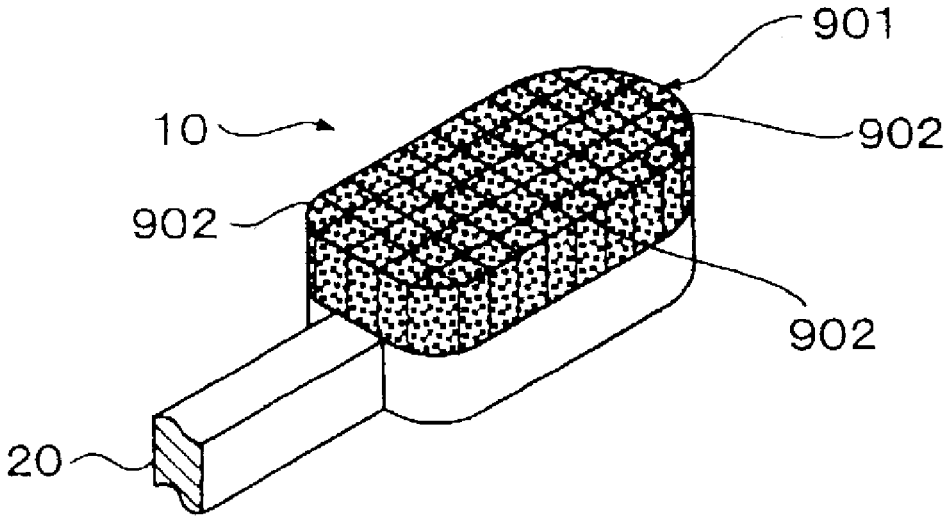
FIG. 32 is a perspective view showing a head having a sponge piece cut in a grid pattern and formed thereon.

FIG. 32 also shows another example of sponge-like cleaning element, in which the sponge piece 901 described above is cut at suitable intervals to form an assembly of sponge slivers 902. The sponge slivers 902 can cope with any configuration or irregularity of teeth and gums more exactly to exhibit higher cleaning effect.

Figure 33:
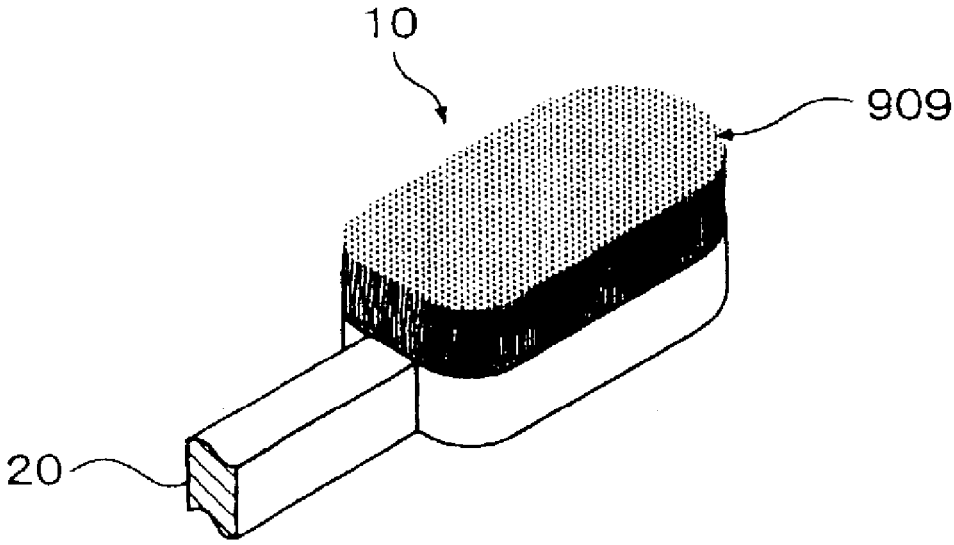
FIG. 33 is a perspective view showing a head having a dense mass of thin fibers.

FIG. 33 shows another example of sponge-like cleaning element, in which fine fibers are implanted in the head 10 in place of bristles 90 to form a dense mass of fibers 909. According to this example, since the tips of fibers forms a surface of the dense mass of fibers 909 as if it has no gaps thereon, the surface of the dense mass of fibers 909 can be brought into almost face contact with teeth and gums to scarcely irritate and injure the teeth and gums compared with bristles 90. The dense mass of fibers 909 may be formed by implanting ultra fine fibers thickly on the upper surface of the head 10 or by adhering a rectangular material on the upper surface of the head 10 and by finely cutting it to form a dense mass of fibers.

The toothbrushes according to the present invention have the constitutions and actions as described above, so that they exhibit the following effects as oral conditioner.

Toothbrushes which are necessary to cope with a individual user's buccal specificity and to maintain sound buccal condition can be integrated into a single toothbrush, and the user can carry out optimal cleaning of his or her teeth, while preventing harmful effects that the conventional toothbrushes frequently give. Further, since the toothbrushes of the present invention have a telescopic structure, they are convenient to carry with.

Since the toothbrushes of the present invention are composed of replaceable parts, they exhibit economical effects and energy saving effects.

The replaceable parts provide wide variations in color, shape and so on, from which users can select depending on their tastes respectively, leading to enhancement of interest, motivation and awareness with respect to tooth-brushing. Besides, technicians can implement preventive programs using the toothbrushes of the present invention.

Since the head is divided into segments, which serve as a functional segment, a stabilizing segment and a sensing segment respectively, the head enables not only adjustment of cleaning performance but also sensory adjustment.

The toothbrushes of the present invention can be maintained hygienically, since they are designed to be disassembled into parts for cleaning, and the parts are made of sterilized materials. In addition, a user can know his or her mannerisms in brushing teeth and the degree of force applied to each part depending on the degree of wearing therein. Further, if a head having a sponge piece adhered thereto or a dense mass of fine fibers implanted in it is used as the element for cleaning teeth, it can effectively prevent injury of teeth and gums.

It should be apparent to those skilled in the art that the present invention may be embodied in many other specific forms without departing from the spirit or scope of the invention.

Therefore, the present examples and embodiments are to be considered as illustrative and not restrictive, and the invention is not to be limited to the details given herein, but may be modified within the scope of the appended claims.

What is claimed is:

1. A toothbrush comprising:

a head comprising a first head segment and a second head segment, each of which has bristles implanted therein;

a neck, wherein the first head segment is attached to a distal end of the neck; and a holder for holding the neck, wherein the second head segment is slidably attached to the neck between the first head segment and the holder, and is pivotal individually around an outer circumference of the neck.

2. The toothbrush according to claim 1, wherein the holder has at a distal end an adjuster for adjusting the length of the neck.

3. The toothbrush according to claim 1, wherein the holder comprises a holder shaft and an outer holder.

4. The toothbrush according to claim 1, wherein the second head segment is designed to be pivotal and replaceable with respect to the neck.

5. The toothbrush according to claim 1, wherein the neck comprises a neck shaft which is of any shape and is selected from a round shaft, an elliptic shaft and a polygonal shaft, and which is straight or curved and has a single shaft or multi shaft structure.

6. The toothbrush according to claim 1, wherein the neck comprises a neck shaft, and a cavity of the neck shaft is employable as a passage for a liquid, a gas, a solid, a powder or a granule, or as a space in which a mechanism is housed.

7. The toothbrush according to claim 1, wherein the neck comprises a neck shaft which can simultaneously contain two kinds of auxiliary cleaning utensils which are used as necessary.

8. The toothbrush according to claim 1, 2 or 4, wherein the first head segment or the second head segment has a protrusion on a bottom surface thereof.

9. The toothbrush according to claim 1, 2, 4, 5, 6 or 7, wherein the neck is designed to be adjustable in length with adjusters respectively.

10. The toothbrush according to claim 1, 2, 4, 5, 6 or 7, wherein the first head segment or the second head segment contains magnet pieces, while the neck contains a vibrator to effect high-speed vibration of bristle tips.

11. The toothbrush according to any of claims 1 to 7, wherein all of the elements are made of a sterilized material.

12. The toothbrush according to any of claims 1 to 7, further including a third head segment which is slidably attached to the neck.

13. A head of a toothbrush, comprising a first head segment to be attached to a distal end of a neck of the toothbrush, and a second head segment which is designed to be slidably and replaceably attached to the neck of the toothbrush between the first head segment and a holder for holding the neck, and is pivotal individually around an outer circumference of the neck.

14. The head according to claim 13 having a cleaning element formed on a surface thereof.

15. The head according to claim 14, wherein the cleaning element formed on a surface thereof is made from sponge.

16. The head according to claim 13, further including a third head segment which is slidably attched to the neck.

17. A toothbrush comprising:

a head having bristles implanted therein, a neck comprising a hollowed holder shaft, wherein the head is attached to a distal end of the neck, and a holder which slidably holds the neck, wherein length of the neck can be adjusted by an adjuster, wherein the head comprises a first, second and third segments, the first segment is attached to the distal end of the neck, the second segment and the third segment penetrate the hollowed holder shaft of the neck so as to be slidably and replaceably attached to the neck between the first head segment and the holder, and the second head segment is pivotal individually around an outer circumference of the neck.

* * * * *